US010456628B2

(12) United States Patent
Tarao et al.

(10) Patent No.: US 10,456,628 B2
(45) Date of Patent: Oct. 29, 2019

(54) GOLF BALL

(71) Applicant: Dunlop Sports Co. Ltd., Kobe-shi, Hyogo (JP)

(72) Inventors: Toshiyuki Tarao, Kobe (JP); Kazuya Kamino, Kobe (JP); Mami Tanaka, Kobe (JP); Hidetaka Inoue, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/842,263

(22) Filed: Dec. 14, 2017

(65) Prior Publication Data

US 2018/0178074 A1 Jun. 28, 2018

(30) Foreign Application Priority Data

Dec. 27, 2016 (JP) ..... 2016-253564

(51) Int. Cl.
*A63B 37/06* (2006.01)
*A63B 37/00* (2006.01)

(52) U.S. Cl.
CPC ..... *A63B 37/0022* (2013.01); *A63B 37/0031* (2013.01); *A63B 37/0043* (2013.01); *A63B 37/0073* (2013.01); *A63B 37/0074* (2013.01); *A63B 37/0075* (2013.01); *A63B 37/0076* (2013.01); *A63B 37/0092* (2013.01); *A63B 37/0096* (2013.01)

(58) Field of Classification Search
CPC ..... A63B 37/0022
USPC ..... 473/378
See application file for complete search history.

(56) References Cited

U.S. PATENT DOCUMENTS

| | | | | |
|---|---|---|---|---|
| 9,168,423 | B2 * | 10/2015 | Tarao | A63B 37/0023 |
| 2011/0244989 | A1 | 10/2011 | Tarao et al. | |
| 2013/0157782 | A1 | 6/2013 | Komatsu et al. | |
| 2013/0157783 | A1 | 6/2013 | Komatsu et al. | |
| 2013/0157784 | A1 | 6/2013 | Komatsu et al. | |
| 2013/0324318 | A1 * | 12/2013 | Isogawa | A63B 37/0076 473/373 |

(Continued)

FOREIGN PATENT DOCUMENTS

| | | |
|---|---|---|
| JP | 2011-217820 A | 11/2011 |
| JP | 2013-126541 A | 6/2013 |

(Continued)

*Primary Examiner* — Raeann Gorden
(74) *Attorney, Agent, or Firm* — Birch, Stewart, Kolasch & Birch LLP

(57) ABSTRACT

An object of the present invention is to provide a golf ball having good spin performance on approach shots and good shot feeling as well as excellent stain resistance by precisely controlling physical properties of a paint film actually formed on a surface of a golf ball body. The present invention provides a golf ball comprising a golf ball body and a paint film formed on a surface of the golf ball body, wherein the paint film is such that a linear approximation curve obtained by a least square method has a slope in an absolute value ranging from 0.0001 to 0.0020 when a loss tangent tan δ thereof measured by a nanoindentation method is plotted as a vertical axis against a measuring frequency (Hz) as a horizontal axis, and that an elastic modulus thereof measured by a nanoindentation method ranges from 0.040 GPa to 0.600 GPa.

18 Claims, 1 Drawing Sheet

(56) References Cited

U.S. PATENT DOCUMENTS

| | | | | |
|---|---|---|---|---|
| 2015/0273276 | A1* | 10/2015 | Isogawa ..... | C08G 18/10<br>473/374 |
| 2016/0184654 | A1 | 6/2016 | Matsuyama et al. | |

FOREIGN PATENT DOCUMENTS

| | | | |
|---|---|---|---|
| JP | 2013-126542 | A | 6/2013 |
| JP | 2013-126543 | A | 6/2013 |
| JP | 2014-14383 | A | 1/2014 |
| JP | 2016-123632 | A | 7/2016 |

* cited by examiner

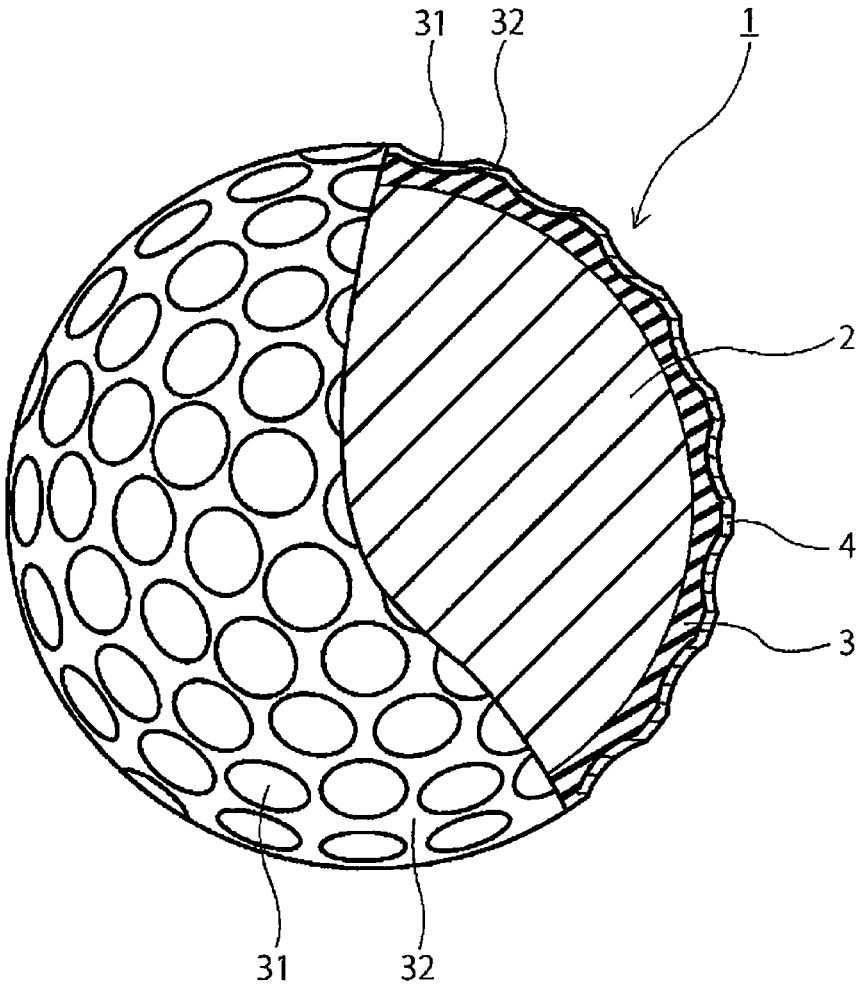
31
32
1
2
4
3
31
32

GOLF BALL

FIELD OF THE INVENTION

The present invention relates to a golf ball, in particular, a golf ball having good spin performance on approach shots and good shot feeling as well as excellent stain resistance.

DESCRIPTION OF THE RELATED ART

A paint film is formed on a surface of a golf ball body. Conventionally, it has been proposed to improve golf ball properties by improving the paint film.

For example, Japanese Patent Publication No. 2011-217820 A discloses a golf ball comprising a golf ball body and a paint film formed on a surface of the golf ball body, wherein the paint film has a martens hardness of 2.0 mgf/$\mu m^2$ or less, and a ratio (50% modulus/10% modulus) of 50% modulus of the paint film to 10% modulus of the paint film is 1.6 or more. The technology of this Japanese Patent Publication tries to provide a golf ball having a high spin rate on approach shots under a wet condition and a rough condition by the paint film. It is noted that, as the paint film sample for measuring the martens hardness, a paint film sheet with a thickness of 100 μm formed from a paint containing a base material and a curing agent, is used (refer to claim 1 and paragraphs 0009, 0057 in Japanese Patent Publication No. 2011-217820 A).

Japanese Patent Publications No. 2013-126541 A, No. 2013-126542 A and No. 2013-126543 A disclose a golf ball comprising a core located in a center of the golf ball, a cover surrounding an outside of the core and having a plurality of dimples on a surface thereof, and a paint layer surrounding an outside of the cover, wherein the paint layer is formed from a material having a Young's Modulus of 70 MPa or less and having rubber elasticity. The technologies of these Japanese Patent Publications try to provide a golf ball exhibiting a great friction force with a golf club and thus having improved spin performance by the paint layer. It is noted that, as the paint layer sample for measuring the Young's Modulus, a sample prepared by molding the materials having each composition into a sheet shape with a thickness of 2 mm by spraying followed by processing the sheet into a dumbbell-like No. 3 test piece in accordance with JIS K6251, is used. In addition, a loss tangent (tan δ) of the paint layer is also measured, and as the paint layer sample for measuring the loss tangent (tan δ), a test piece with a thickness of 1 mm is used (refer to claims 1, 4 and paragraphs 0014, 0036, 0037, 0058 in Japanese Patent Publication No. 2013-126541 A; claims 1, 6 and paragraphs 0015, 0037, 0038, 0059 in Japanese Patent Publication No. 2013-126542 A; and claims 1, 5 and paragraphs 0015, 0037, 0038, 0059 in Japanese Patent Publication No. 2013-126543 A).

Japanese Patent Publication No. 2014-014383 A discloses a golf ball comprising a golf ball body and a paint film formed on a surface of the golf ball body, wherein the paint film has a storage modulus (E') of $1.00\times10^7$ dyn/$cm^2$ or more and $1.00\times10^8$ dyn/$cm^2$ or less at a temperature range from 120° C. to 150° C. measured with a dynamic viscoelasticity measuring device, and a loss tangent (tan δ) of 0.050 or more at the temperature of 10° C. The technology of this Japanese Patent Publication tries to provide a golf ball having excellent controllability on approach shots of less than 40 yards, especially on approach shots from around a green (approximately from 10 yards to 20 yards), and excellent shot feeling. It is noted that, as the paint film sample for measuring the storage modulus (E') and the loss tangent (tan δ), a test piece with a thickness of from 0.11 mm to 0.14 mm formed from a paint containing a base material and a curing agent, is used (refer to claim 1 and paragraphs 0013, 0092 in Japanese Patent Publication No. 2014-014383 A).

Japanese Patent Publication No. 2016-123632 A discloses a golf ball comprising a golf ball body and a paint film formed on a surface of the golf ball body, wherein a base resin constituting the paint film is a polyurethane obtained through a reaction between a polyol composition and a polyisocyanate composition, a molar ratio (NCO/OH) of an isocyanate group (NCO group) in the polyisocyanate composition to a hydroxyl group (OH group) in the polyol composition is 0.6 or more, and the paint film has an elastic modulus of 300 MPa or less. The technology of this Japanese Patent Publication tries to provide a golf ball having excellent shot feeling and stain resistance by the paint film. It is noted that the elastic modulus of the paint film is directly measured on the paint film formed on the surface of the golf ball with a scanning probe microscope in an atomic force microscope mode (refer to claim 1 and paragraphs 0009, 0060 in Japanese Patent Publication No. 2016-123632 A).

SUMMARY OF THE INVENTION

However, the golf balls provided in the technologies of the above mentioned Japanese Patent Publications do not always have satisfactory various performances such as spin performance on approach shots, shot feeling and stain resistance, there is still room for improvement.

In Japanese Patent Publications No. 2011-217820 A, No. 2013-126541 A, No. 2013-126542 A, No. 2013-126543 A and No. 2014-014383 A, various physical properties of the paint film are measured by using a measuring sample formed from the constituent materials of the paint film, rather than the actual paint film formed on the surface of the golf ball body. The measuring sample has a much greater thickness than the paint film actually formed on the surface of the golf ball body. Thus, there is a problem that even if the performances of the paint film are controlled based on the physical properties of the measuring sample, the paint film actually formed on the surface of the golf ball body may fail to exhibit the desired performances. In addition, in the technology of Japanese Patent Publication No. 2016-123632 A, the elastic modulus of the paint film is directly measured on the paint film formed on the surface of the golf ball with a scanning probe microscope in an atomic force microscope mode. However, the measured elastic modulus is much affected by the cover under the paint film and thus is considered not to be the elastic modulus of the paint film itself.

The present invention has been achieved in view of the above problems. An object of the present invention is to provide a golf ball having good spin performance on approach shots and good shot feeling as well as excellent stain resistance by precisely controlling physical properties of a paint film actually formed on a surface of a golf ball body.

The present invention that has solved the above problems provides a golf ball comprising a golf ball body and a paint film formed on a surface of the golf ball body, wherein the paint film is such that a linear approximation curve obtained by a least square method has a slope in an absolute value ranging from 0.0001 to 0.0020 when a loss tangent tan δ of the paint film in a state of being formed on the surface of the golf ball body measured by the following measuring condition 1 is plotted as a vertical axis against a measuring frequency (Hz) as a horizontal axis, and that an elastic modulus of the paint film in the state of being formed on the surface of the golf ball body measured by the following measuring condition 2 ranges from 0.040 GPa to 0.600 GPa:

<Measuring Condition 1>

Measuring apparatus: "TI950 Tribo Indenter" available from Hysitron, Inc.

Indenter specification: Berkovich type

Test load (maximum indenting load): 100 μN

Frequency: 1 Hz, 10 Hz, 105 Hz

Measuring environment: 23° C., RH 50%, in the atmosphere;

<Measuring Condition 2>

Measuring apparatus: "TI950 Tribo Indenter" available from Hysitron, Inc.

Indenter specification: Berkovich type

Maximum indenting depth: 300 nm

Measuring environment: 23° C., RH 50%, in the atmosphere.

According to the present invention, physical properties of the paint film actually formed on the golf ball are precisely controlled, and the obtained golf ball has good spin performance on approach shots and good shot feeling as well as excellent stain resistance.

BRIEF DESCRIPTION OF THE DRAWINGS

The FIGURE is a partially cutaway cross-sectional view showing a golf ball according to one embodiment of the present invention.

DESCRIPTION OF THE PREFERRED EMBODIMENT

The present invention provides a golf ball comprising a golf ball body and a paint film formed on a surface of the golf ball body, wherein the paint film is such that a linear approximation curve obtained by a least square method has a slope in an absolute value ranging from 0.0001 to 0.0020 when a loss tangent tan δ of the paint film in a state of being formed on the surface of the golf ball body measured by the following measuring condition 1 is plotted as a vertical axis against a measuring frequency (Hz) as a horizontal axis, and that an elastic modulus of the paint film in the state of being formed on the surface of the golf ball body measured by the following measuring condition 2 ranges from 0.040 GPa to 0.600 GPa:

<Measuring Condition 1>

Measuring apparatus: "TI950 Tribo Indenter" available from Hysitron, Inc.

Indenter specification: Berkovich type

Test load (maximum indenting load): 100 μN

Frequency: 1 Hz, 10 Hz, 105 Hz

Measuring environment: 23° C., RH 50%, in the atmosphere;

<Measuring Condition 2>

Measuring apparatus: "TI950 Tribo Indenter" available from Hysitron, Inc.

Indenter specification: Berkovich type

Maximum indenting depth: 300 nm

Measuring environment: 23° C., RH 50%, in the atmosphere.

In the present invention, the actual physical properties of the paint film can be measured highly precisely under the measuring conditions 1 and 2, by using the paint film formed on the surface of the golf ball body as an object to be directly measured.

Specifically, the measuring condition 1 is based on the following nanoindentation method. That is, "TI950 Tribo Indenter" available from Hysitron, Inc. is used as a measuring apparatus, the measuring apparatus is set to a dynamic viscoelasticity mode, a tip of a Berkovich type indenter (made of diamond and having a shape of triangular pyramid) is indented into the paint film which is a measuring object with a nanoload such as a submilli Newton (maximum indenting load is set to 100 μN in the measuring condition 1) to provide a nanostrain, and the dynamic viscoelasticity of the paint film is calculated based on the obtained response.

In addition, the measuring condition 2 is based on the following nanoindentation method. That is, "TI950 Tribo Indenter" available from Hysitron, Inc. is used as a measuring apparatus, the measuring apparatus is set to an indenting mode, a tip of a Berkovich type indenter (made of diamond and having a shape of triangular pyramid) is indented into the paint film which is a measuring object with a nanoload such as a submilli Newton to continuously measure an indenting load (applied load) and an indenting depth (displacement) of the indenter (maximum indenting depth is set to 300 nm in the measuring condition 2), a relationship of the indenting load of the indenter against the indenting depth of the indenter is plotted to obtain a load-displacement curve, and the hardness or elastic modulus of the paint film is calculated based on the obtained load-displacement curve.

The indenting depth in the measuring conditions 1, 2 based on the nanoindentation method is only about one-tenths to one-hundredths of the thickness of the paint film, thus various physical properties of the paint film can be accurately measured by the measuring conditions 1, 2 without being affected by the golf ball body under the paint film. Accordingly, the various physical properties measured by the measuring conditions 1, 2 are considered to be the physical properties of the paint film itself. Since the actual physical properties of the paint film can be measured by the measuring conditions 1, 2, the golf ball exerting the desired paint film performance can be obtained.

In the present invention, a linear approximation curve obtained by a least square method has a slope in an absolute value ranging from 0.0001 to 0.0020 when a loss tangent tan δ of the paint film in the state of being formed on the surface of the golf ball body measured by the above measuring condition 1 is plotted as a vertical axis against a measuring frequency (Hz) as a horizontal axis. If the linear approximation curve of the paint film has the slope in an absolute value ranging from 0.0001 to 0.0020, the obtained golf ball has especially improved stain resistance.

From the viewpoint of further enhancing the stain resistance of the golf ball, the absolute value of the slope of the linear approximation curve of the paint film is preferably 0.0004 or more, more preferably 0.0005 or more, and even more preferably 0.0008 or more, and is preferably 0.0018 or less, more preferably 0.0017 or less, and even more preferably 0.0015 or less.

Specifically, the loss tangent tan δ is measured at the measuring frequencies of 1 Hz, 10 Hz, 105 Hz (test load, i.e. maximum indenting load is set to 100 μN). The loss tangent tan δ is plotted against the measuring frequencies of 1 Hz, 10 Hz, 105 Hz with the measuring frequency (Hz) as the horizontal axis and the loss tangent tan δ as the vertical axis. The slope of the linear approximation curve is calculated based on the obtained three plotted points. It is noted that the loss tangent tan δ is a ratio (loss modulus/storage modulus)

of the loss modulus to the storage modulus, and is calculated from the loss modulus and the storage modulus measured by the measuring condition 1.

The loss tangent tan δ of the paint film in the state of being formed on the surface of the golf ball body at the measuring frequency of 1 Hz is preferably 0.200 or more, more preferably 0.250 or more, even more preferably 0.300 or more, and most preferably 0.350 or more, and is preferably 0.700 or less, more preferably 0.650 or less, even more preferably 0.600 or less, and most preferably 0.550 or less. If the loss tangent tan δ of the paint film at the measuring frequency of 1 Hz falls within the above range, the obtained golf ball has further enhanced spin performance on approach shots and shot feeling while maintaining the stain resistance thereof.

The loss tangent tan δ of the paint film in the state of being formed on the surface of the golf ball body at the measuring frequency of 10 Hz is preferably 0.150 or more, more preferably 0.160 or more, even more preferably 0.200 or more, and most preferably 0.250 or more, and is preferably 0.400 or less, more preferably 0.380 or less, even more preferably 0.360 or less, and most preferably 0.340 or less. If the loss tangent tan δ of the paint film at the measuring frequency of 10 Hz falls within the above range, the obtained golf ball has further enhanced spin performance on approach shots and shot feeling while maintaining the stain resistance thereof.

The loss tangent tan δ of the paint film in the state of being formed on the surface of the golf ball body at the measuring frequency of 105 Hz is preferably 0.140 or more, more preferably 0.180 or more, even more preferably 0.200 or more, and most preferably 0.220 or more, and is preferably 0.300 or less, more preferably 0.280 or less, even more preferably 0.270 or less, and most preferably 0.260 or less. If the loss tangent tan δ of the paint film at the measuring frequency of 105 Hz falls within the above range, the obtained golf ball has further enhanced spin performance on approach shots and shot feeling while maintaining the stain resistance thereof.

In the present invention, the elastic modulus of the paint film in the state of being formed on the surface of the golf ball body measured by the above measuring condition 2 ranges from 0.040 GPa to 0.600 GPa. If the elastic modulus of the paint film ranges from 0.040 GPa to 0.600 GPa, the obtained golf ball has further enhanced spin performance on approach shots and shot feeling while maintaining the stain resistance thereof.

From the viewpoint of further enhancing the spin performance on approach shots and shot feeling, the elastic modulus of the paint film in the state of being formed on the surface of the golf ball body is preferably 0.060 GPa or more, more preferably 0.100 GPa or more, and even more preferably 0.150 GPa or more, and is preferably 0.500 GPa or less, more preferably 0.400 GPa or less, and even more preferably 0.300 GPa or less.

The hardness of the paint film in the state of being formed on the surface of the golf ball body measured by the measuring condition 2 is preferably 0.001 GPa or more, more preferably 0.002 GPa or more, and even more preferably 0.003 GPa or more, and is preferably 0.020 GPa or less, more preferably 0.015 GPa or less, even more preferably 0.010 GPa or less, and most preferably 0.005 GPa or less. If the hardness of the paint film measured by the measuring condition 2 falls within the above range, the obtained golf ball has further enhanced spin performance on approach shots and shot feeling while maintaining the stain resistance thereof. In addition, the paint film has better durability. It is noted that the hardness of the paint film is a hardness calculated from the indenting load F (i.e. load applied at the maximum displacement of 300 nm) when the indenter is indented into the paint film in a depth of 300 nm by the measuring condition 2.

The 10% elastic modulus of the paint film is preferably 20 kgf/cm$^2$ (2.0 MPa) or more, more preferably 30 kgf/cm$^2$ (2.9 MPa) or more, and even more preferably 40 kgf/cm$^2$ (3.9 MPa) or more, and is preferably 180 kgf/cm$^2$ (17.6 MPa) or less, more preferably 150 kgf/cm$^2$ (14.7 MPa) or less, and even more preferably 100 kgf/cm$^2$ (9.8 MPa) or less. If 10% elastic modulus of the paint film is 20 kgf/cm$^2$ or more, the paint film has better stain resistance, and if 10% elastic modulus of the paint film is 180 kgf/cm$^2$ or less, the spin performance on approach shots is further enhanced. It is noted that the 10% elastic modulus is measured by the method described later.

The paint film may have a single-layered construction (including the case where the same paint is applied for a plurality of times) or a multiple-layered construction composed of at least two layers (the case where two layers adjacent to each other are formed from paints different from each other), and the paint film having the single-layered construction (including the case where the same paint is applied for several times) is preferred from the viewpoint of more precisely measuring the physical properties of the paint film by the measuring conditions 1, and 2.

The thickness of the paint film is preferably 5 μm or more, more preferably 10 μm or more, and even more preferably 15 μm or more. If the thickness of the paint film is less than 5 μm, the paint film may be easy to wear off due to the continued use of the golf ball. If the thickness of the paint film is great, the spin rate on approach shots increases. In addition, the thickness of the paint film is preferably 50 μm or less, more preferably 45 μm or less, and even more preferably 40 μm or less. If the thickness of the paint film exceeds 50 μm, the dimple effect is reduced and thus the flight performance of the golf ball may be lowered. The thickness of the paint film can be obtained, for example, by measuring a cross section of the golf ball with a microscope (VHX-1000 available from Keyence Corporation). It is noted that the thickness of the paint film is a total thickness of the formed paint film.

The above mentioned various physical properties of the paint film can be controlled by appropriately choosing the type of the base resin constituting the paint film, for examples, the type or amount of the components blended in the base resin.

Examples of the base resin constituting the paint film include polyurethane, epoxy resin, acrylic resin, vinyl acetate resin, and polyester. Among them, the polyurethane is preferred. If the base resin constituting the paint film is the polyurethane, various physical properties of the paint film can be easily obtained by adjusting the amount of the polyol composition or the polyisocyanate composition, or the mixing ratio thereof.

(Polyurethane Paint)

The base resin constituting the paint film is preferably a polyurethane formed from a paint containing a polyol composition and a polyisocyanate composition. The reaction between the polyol composition and the polyisocyanate composition forms the polyurethane. As the paint, a so-called curing type urethane paint containing a polyol as a base material and a polyisocyanate as a curing agent can be exemplified.

(Polyol Composition)

The polyol composition contains a polyol compound. Examples of the polyol compound include a compound having two or more hydroxyl groups in the molecule. The polyol compound may be used solely or as a mixture of at least two of them.

Examples of the polyol compound include a low molecular weight polyol having a molecular weight of less than 500, and a high molecular weight polyol having a number average molecular weight of 500 or more. Examples of the low molecular weight polyol include a diol such as ethylene glycol, diethylene glycol, triethylene glycol, 1,3-butanediol, 1,4-butanediol, neopentyl glycol, and 1,6-hexanediol; and a trial such as glycerin, trimethylolpropane, and hexanetriol. Examples of the high molecular weight polyol include a polyether polyol, a polyester polyol, a polycaprolactone polyol, a polycarbonate polyol, a urethane polyol, and an acrylic polyol.

Examples of the polyether polyol include polyoxyethylene glycol (PEG), polyoxypropylene glycol (PPG), and polyoxytetramethylene glycol (PTMG). Examples of the polyester polyol include polyethylene adipate (PEA), polybutylene adipate (PBA), and polyhexamethylene adipate (PHMA). Examples of the polycaprolactone polyol include poly-ε-caprolactone (PCL). Examples of the polycarbonate polyol include polyhexamethylene carbonate.

The urethane polyol is a compound having a plurality of urethane bonds in the molecule, and having two or more hydroxyl groups in one molecule. Examples of the urethane polyol include a urethane prepolymer obtained by a reaction between a polyol component and a polyisocyanate component, under a condition that the amount of hydroxyl groups in the polyol component is excessive to the amount of isocyanate groups in the polyisocyanate component.

Examples of the polyol component constituting the urethane polyol include a diol component such as a polyether diol, a polyester diol, a polycaprolactone diol and a polycarbonate diol. The polyether diol is preferred. Examples of the polyether diol include polyoxyethylene glycol, polyoxypropylene glycol, and polyoxytetramethylene glycol. Among them, the polyoxytetramethylene glycol is preferred.

The number average molecular weight of the polyether diol is preferably 550 or more, more preferably 600 or more, and even more preferably 650 or more, and is preferably 3000 or less, more preferably 2500 or less, and even more preferably 2000 or less. If the number average molecular weight of the polyether diol is 550 or more, the distance between crosslinking points in the paint film becomes long, the paint film becomes soft, and thus the golf ball has enhanced spin performance on approach shots and shot feeling. If the number average molecular weight of the polyether diol is 3,000 or less, the distance between crosslinking points in the paint film does not become excessively long, and thus the stain resistance of the paint film becomes better. It is noted that the number average molecular weight of the polyol component can be measured, for example, by gel permeation chromatography (GPC), using polystyrene as a standard material, tetrahydrofuran as an eluate, and an organic solvent system GPC column (e.g. "Shodex (registered trademark) KF series" available from Showa Denko K.K.) as a column.

The polyol component may further contain a low molecular weight polyol having a molecular weight of less than 500. Examples of the low molecular weight polyol include a diol such as ethylene glycol, diethylene glycol, triethylene glycol, 1,3-butanediol, 1,4-butanediol, neopentyl glycol, and 1,6-hexanediol; and a triol such as glycerin, trimethylolpropane, and hexanetriol. The low molecular weight polyol may be used solely or as a mixture of at least two of them.

The polyol component constituting the urethane polyol preferably includes the triol component and the diol component. As the triol component, trimethylolpropane is preferred. The mixing ratio (triol component/diol component) of the triol component to the diol component is preferably 0.2 or more, more preferably 0.3 or more, and even more preferably 0.5 or more, and is preferably 6.0 or less, more preferably 4.0 or less, even more preferably 2.0 or less, and most preferably 1.0 or less in a molar ratio. If the polyol component constituting the urethane polyol includes the triol component and the diol component in the mixing ratio falling within the above range, the golf ball has further enhanced spin performance on approach shots as well as better stain resistance and durability.

The polyisocyanate component constituting the urethane polyol is not particularly limited, as long as it has two or more isocyanate groups. Examples of the polyisocyanate component include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and para-phenylene diisocyanate (PPDI); and an alicyclic polyisocyanate or aliphatic polyisocyanate such as 4,4'-dicyclohexylmethane diisocyanate ($H_{12}MDI$), hydrogenated xylylene diisocyanate ($H_6XDI$), hexamethylene diisocyanate (HDI), isophorone diisocyanate (IPDI), and norbornene diisocyanate (NBDI). These polyisocyanates may be used solely, or at least two of them may be used in combination.

The amount of the polyether diol in the urethane polyol is preferably 50 mass % or more, more preferably 60 mass % or more, and even more preferably 65 mass % or more. The polyether diol forms a soft segment in the paint film. Therefore, if the amount of the polyether diol is 50 mass % or more, the obtained golf ball has further enhanced spin performance and shot feeling.

The weight average molecular weight of the urethane polyol is preferably 3,000 or more, more preferably 4,000 or more, and even more preferably 4,500 or more, and is preferably 10,000 or less, more preferably 8,000 or less, and even more preferably 6,000 or less. If the weight average molecular weight of the urethane polyol is 3,000 or more, the distance between crosslinking points in the paint film becomes long, the paint film becomes soft, and thus the golf ball has enhanced spin performance on approach shots and shot feeling. If the weight average molecular weight of the urethane polyol is 10,000 or less, the distance between crosslinking points in the paint film does not become excessively long, and thus the stain resistance of the paint film becomes better.

The hydroxyl value of the urethane polyol is preferably 20 mg KOH/g or more, more preferably 30 mg KOH/g or more, and even more preferably 50 mg KOH/g or more, and is preferably 100 mg KOH/g or less, more preferably 90 mg KOH/g or less, and even more preferably 80 mg KOH/g or less. It is noted that the hydroxyl value can be measured by, for example, an acetylization method, in accordance with JIS K 1557-1.

The polyol composition preferably contains the urethane polyol as the polyol compound. The amount of the urethane polyol in the polyol compound of the polyol composition is preferably 60 mass % or more, more preferably 70 mass % or more, and even more preferably 80 mass % or more. In addition, it is most preferred that the polyol compound of the polyol composition consists of the urethane polyol.

(Polyisocyanate Composition)

Next, the polyisocyanate composition will be explained. The polyisocyanate composition contains a polyisocyanate compound. Examples of the polyisocyanate compound include a compound having two or more isocyanate groups.

Examples of the polyisocyanate compound include an aromatic diisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODD, xylylene diisocyanate (XDI), tetramethylxylylene diisocyanate (TMXDI), and para-phenylene diisocyanate (PPDI); an alicyclic diisocyanate or aliphatic diisocyanate such as 4,4'-dicyclohexylmethane diisocyanate ($H_{12}$MDI), hydrogenated xylylene diisocyanate ($H_6$XDI), hexamethylene diisocyanate (HDI), isophorone diisocyanate (IPDI), and norbornene diisocyanate (NBDI); and a triisocyanate such as an allophanate-modified product, a biuret-modified product, an isocyanurate-modified product and an adduct product of the above diisocyanates. The polyisocyanate may be used solely, or at least two of them may be used in combination.

The allophanate-modified product is, for example, a triisocyanate obtained by further reacting a diisocyanate with a urethane bond formed through a reaction between a diisocyanate and a low molecular weight diol. The adduct product is a triisocyanate obtained through a reaction between a diisocyanate and a low molecular weight triol such as trimethylolpropane or glycerin. The biuret-modified product is, for example, a triisocyanate having a biuret bond represented by the following chemical formula (1). The isocyanurate-modified product of the diisocyanate is, for example, a triisocyanate represented by the following chemical formula (2).

[Chemical formula 1]

(1)

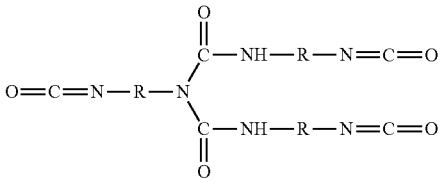

[Chemical formula 2]

(2)

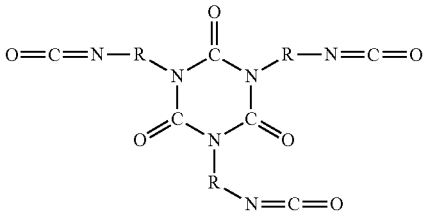

In the chemical formulae (1) and (2), R represents a residue where isocyanate groups are removed from the diisocyanate.

As the triisocyanate, at least one member selected from the group consisting of an isocyanurate-modified product of hexamethylene diisocyanate, a biuret-modified product of hexamethylene diisocyanate and an isocyanurate-modified product of isophorone diisocyanate is preferred, and the combined use of these modified products is more preferred. In particular, in case of using the biuret-modified product of hexamethylene diisocyanate and the isocyanurate-modified product of hexamethylene diisocyanate in combination, a mixing ratio (biuret-modified product/isocyanurate-modified product) thereof preferably ranges from 0.5 to 2.0, more preferably ranges from 0.8 to 1.5, and even more preferably ranges from 0.9 to 1.4 in a mass ratio. In addition, in case of using the modified product of hexamethylene diisocyanate (biuret-modified product and/or isocyanurate-modified product) and the isocyanurate-modified product of isophorone diisocyanate in combination, a mixing ratio (the modified product of hexamethylene diisocyanate/isocyanurate-modified product of isophorone diisocyanate) thereof preferably ranges from 0.5 to 3.0, more preferably ranges from 0.8 to 2.5, and even more preferably ranges from 1.0 to 2.0 in a mass ratio.

The polyisocyanate composition preferably contains the triisocyanate compound as the polyisocyanate compound. The amount of the triisocyanate compound in the polyisocyanate compound of the polyisocyanate composition is preferably 60 mass % or more, more preferably 70 mass % or more, and even more preferably 80 mass % or more. In addition, it is most preferred that the polyisocyanate compound of the polyisocyanate composition consists of the triisocyanate compound.

The amount of the isocyanate group (NCO %) in the polyisocyanate compound contained in the polyisocyanate composition is preferably 0.5 mass % or more, more preferably 1 mass % or more, and even more preferably 2 mass % or more, and is preferably 45 mass % or less, more preferably 40 mass % or less, and even more preferably 35 mass % or less. It is noted that the amount of the isocyanate group (NCO %) in the polyisocyanate can be defined by the following expression.

NCO (%)=100×[mole number of isocyanate groups in the polyisocyanate×42 (molecular weight of NCO)]/[total mass (g) of the polyisocyanate]

Specific examples of the polyisocyanate include Burnock D-800, Burnock DN-950, and Burnock DN-955 available from DIC corporation; Desmodur Z4470, Desmodur N75MPA/X, Desmodur N3300, Desmodur L75 (C), and Sumidur E21-1 available from Sumika Bayer Urethane Co., Ltd.; Coronate HX and Coronate HK available from Nippon Polyurethane Industry Co., Ltd.; Duranate 24A-100, Duranate 21S-75E, Duranate TPA-100, and Durante TKA-100 available from Asahi Kasei Chemicals Corporation; and VESTANAT T1890 available from Degussa.

In the curing reaction of the curing type paint composition, the mass ratio (polyol composition/polyisocyanate composition) of the polyol composition to the polyisocyanate composition is preferably 3.5 or more, more preferably 4.0 or more, even more preferably 5.0 or more, and most preferably 6.0 or more, and is preferably 10.0 or less, more preferably 9.0 or less, and even more preferably 8.5 or less. If the mass ratio (polyol composition/polyisocyanate composition) of the curing type paint composition falls within the above range, the above mentioned various physical properties of the obtained paint film are easily satisfied, and thus a golf ball having good spin performance on approach shots and good shot feeling as well as excellent stain resistance is easily obtained. On the other hand, if the mass ratio is less than 3.5, the paint film becomes so hard that the obtained golf ball may have dissatisfactory spin performance on approach shots and shot feeling. In addition, if the mass ratio is more than 10.0, the paint film becomes so soft that the obtained golf ball may have dissatisfactory stain resistance.

In the curing reaction of the curing type paint composition, the molar ratio (NCO group/OH group) of the isocyanate group (NCO group) in the curing agent to the hydroxyl group (OH group) in the base material is preferably 0.15 or more, more preferably 0.18 or more, even more preferably 0.20 or more, and most preferably 0.22 or more, and is preferably 1.20 or less, more preferably 1.10 or less, and even more preferably 1.00 or less. If the molar ratio (NCO group/OH group) of the curing type paint composition falls within the above range, the above mentioned various physical properties of the obtained paint film are easily satisfied, and thus a golf ball having good spin performance on approach shots and good shot feeling as well as excellent stain resistance is easily obtained. On the other hand, if the molar ratio is less than 0.15, the obtained paint film becomes so soft that defectiveness may occur during the manufacturing process. In addition, if the molar ratio is more than 1.20, the obtained paint film becomes so hard that the obtained golf ball may have inferior spin performance.

The paint may be either a waterborne paint mainly containing water as a dispersion medium or a solvent-based paint containing an organic solvent as a dispersion medium, and the solvent-based paint is preferred. In case of the solvent-based paint, preferable examples of the solvent include toluene, isopropyl alcohol, xylene, methyl ethyl ketone, methyl ethyl isobutyl ketone, ethylene glycol monomethyl ether, ethylbenzene, propylene glycol monomethyl ether, isobutyl alcohol, ethyl acetate, and butyl acetate. It is noted that the solvent may be added into either the polyol composition or the polyisocyanate composition, and from the viewpoint of uniformly performing the curing reaction, the solvent is preferably added into both the polyol composition and the polyisocyanate composition.

In the curing reaction, a publicly known catalyst may be used. Examples of the catalyst include a monoamine such as triethylamine and N,N-dimethylcyclohexylamine; a polyamine such as N,N,N',N'-tetramethylethylene diamine and N,N,N',N",N"-pentamethyldiethylene triamine; a cyclic diamine such as 1,8-diazabicyclo-[5.4.0]-7-undecene (DBU) and triethylenediamine; and a tin-based catalyst such as dibutyl tin dilaurylate and dibutyl tin diacetate. These catalysts may be used solely, or at least two of them may be used in combination. Among them, the tin-based catalyst such as dibutyl tin dilaurylate and dibutyl tin diacetate is preferable, and dibutyl tin dilaurylate is particularly preferable.

If necessary, the paint may further contain an additive generally contained in a golf ball paint, such as a filler, an ultraviolet absorber, an antioxidant, a light stabilizer, a fluorescent brightener, an anti-blocking agent, a leveling agent, a slip agent, and a viscosity modifier.

The method of applying the curing type paint of the present invention is not particularly limited, and a conventionally known method such as a spray coating method or an electrostatic coating method may be employed.

In case of spray coating using an air gun, the polyol composition and the polyisocyanate composition may be fed with respective pumps and continuously mixed with a line mixer located in the stream line just before the air gun, and the obtained mixture is subjected to spray coating. Alternatively, the polyol composition and the polyisocyanate composition may be subjected to spray coating separately by using an air spray system provided with a mixing ratio controlling device. The paint application may be conducted by spray coating one time or overspraying several times.

The curing type paint applied to the golf ball body may be dried, for example, at a temperature ranging from 30° C. to 70° C. for 1 hour to 24 hours to form the paint film.

The golf ball according to the present invention is not particularly limited, as long as it comprises a golf ball body and a paint film formed on a surface of the golf ball body. The construction of the golf ball body is not particularly limited, and may be a one-piece golf ball; a two-piece golf ball; a three-piece golf ball; a four-piece golf ball; a multi-piece golf ball comprising five or more pieces; or a wound golf ball. The present invention can be applied appropriately to any one of the above golf ball bodies.

The FIGURE is a partially cutaway cross-sectional view of a golf ball 1 according to one embodiment of the present invention (schematic drawing). The golf ball 1 comprises a spherical core 2, a cover 3 covering the spherical core 2, and a paint film 4 formed on a surface of the cover 3. A plurality of dimples 31 are formed on the surface of the cover 3. Other portions than the dimples 31 on the surface of the cover 3 are land 32.

Next, the one-piece golf ball body and the core used in a wound golf ball, two-piece golf ball and multi-piece golf ball will be explained.

The core may be either a single-layered construction, or a multi-layered construction composed of at least two layers, without any limitation. The core preferably has a single-layered construction. Unlike the multi-layered core, the single-layered core does not have an energy loss at the interface of the multi-layered construction when being hit, and thus has better resilience. The core preferably has a spherical shape.

The one-piece golf ball body and the core may be formed by using a conventional rubber composition (hereinafter, sometimes simply referred to as "core rubber composition"). For example, the one-piece golf ball body and the core may be formed by heat pressing a rubber composition containing a base rubber, a co-crosslinking agent, and a crosslinking initiator.

As the base rubber, particularly preferred is a high cis-polybutadiene having a cis-bond which is beneficial to the resilience in an amount of 40 mass % or more, preferably 70 mass % or more, and more preferably 90 mass % or more. As the co-crosslinking agent, an α,β-unsaturated carboxylic acid having 3 to 8 carbon atoms or a metal salt thereof is preferred, and acrylic acid metal salt and methacrylic acid metal salt are more preferred. As the metal constituting the metal salt, zinc, magnesium, calcium, aluminum and sodium are preferred, and zinc is more preferred. The amount of the co-crosslinking agent is preferably 20 parts by mass or more and 50 parts by mass or less with respect to 100 parts by mass of the base rubber. When the α,β-unsaturated carboxylic acid having 3 to 8 carbon atoms is used as the co-crosslinking agent, a metal compound is preferably blended. When the metal salt of the α,β-unsaturated carboxylic acid having 3 to 8 carbon atoms is used as the co-crosslinking agent, the metal compound may be blended. As the crosslinking initiator, an organic peroxide is preferably used. Specific examples of the organic peroxide include dicumyl peroxide, 1,1-bis(t-butylperoxy)-3,3,5-trimethylcyclohexane, 2,5-dimethyl-2,5-di(t-butylperoxy) hexane and di-t-butyl peroxide. Among them, dicumyl peroxide is preferably used. The amount of the crosslinking initiator is preferably 0.2 part by mass or more, more preferably 0.3 part by mass or more, and is preferably 3 parts by mass or less, more preferably 2 parts by mass or less, with respect to 100 parts by mass of the base rubber.

The core rubber composition may further contain an organic sulfur compound. Preferable examples of the organic sulfur compound include diphenyl disulfides (e.g. diphenyl disulfides, bis(pentabromophenyl) disulfides), thiophenols, and thionaphthols (e.g. 2-thionaphthol). The amount of the organic sulfur compound is preferably 0.1 part by mass or more, more preferably 0.3 part by mass or more, and is preferably 5.0 parts by mass or less, more preferably 3.0 parts by mass or less, with respect to 100 parts by mass of the base rubber. The core rubber composition may further contain a carboxylic acid and/or a salt thereof. As the carboxylic acid and/or the salt thereof, a carboxylic acid having 1 to 30 carbon atoms and/or a salt thereof is preferred. As the carboxylic acid, either an aliphatic carboxylic acid or an aromatic carboxylic acid (such as benzoic acid) may be used. The amount of the carboxylic acid and/or the salt thereof is 1 part by mass or more and 40 parts by mass or less with respect to 100 parts by mass of the base rubber.

The core rubber composition may further contain a weight adjusting agent such as zinc oxide and barium sulfate, an antioxidant, a colored powder, or the like appropriately, in addition to the base rubber, the co-crosslinking agent, the crosslinking initiator and the organic sulfur compound.

Conditions for molding the core rubber composition by a heat pressing method may be set appropriately in accordance with the formulation of the core rubber composition. Generally, it is preferred that the core rubber composition is heated at 130° C. to 200° C. for 10 to 60 minutes, or alternatively the core rubber composition is subjected to a two-step heating, i.e. the core rubber composition is heated at 130° C. to 150° C. for 20 to 40 minutes and then heated at 160° C. to 180° C. for 5 to 15 minutes.

The hardness difference (Hs−Ho) between the surface hardness Hs of the core and the center hardness Ho of the core is preferably 10 or more, more preferably 15 or more, and even more preferably 20 or more in Shore C hardness. If the hardness difference (Hs−Ho) is 10 or more, the spin rate on driver shots is further lowered and thus the flight distance on driver shots is greater. In addition, the hardness difference (Hs−Ho) is preferably 50 or less, more preferably 45 or less, even more preferably 40 or less, and most preferably 35 or less in Shore C hardness. If the hardness difference (Hs−Ho) is 50 or less, the golf ball has better durability.

The center hardness Ho of the core is preferably 40 or more, more preferably 45 or more, and even more preferably 50 or more in Shore C hardness. If the center hardness Ho of the core is 40 or more, the golf ball has better resilience and thus the flight distance thereof on driver shots is greater. In addition, the center hardness Ho of the core is preferably 80 or less, more preferably 75 or less, and even more preferably 70 or less in Shore C hardness. If the center hardness Ho of the core is 80 or less, the golf ball has better shot feeling.

The surface hardness Hs of the core is preferably 60 or more, more preferably 65 or more, and even more preferably 70 or more in Shore C hardness. If the surface hardness Hs of the core is 60 or more, the golf ball has better resilience and thus the flight distance thereof on driver shots is greater. In addition, the surface hardness Hs of the core is preferably 100 or less, more preferably 95 or less, and even more preferably 90 or less in Shore C hardness. If the surface hardness Hs of the core is 100 or less, the core does not become too hard and thus the durability thereof is better.

The diameter of the core is preferably 37.0 mm or more, more preferably 37.5 mm or more, and even more preferably 38.5 mm or more. If the core has the diameter of 37.0 mm or more, the resilience thereof is better. The upper limit of the diameter of the core is preferably 40.5 mm or less, more preferably 40.0 mm or less, and even more preferably 39.8 mm or less, without any limitation.

When the core has a diameter in a range from 37.0 mm to 40.5 mm, the compression deformation amount of the core (shrinking amount of the core along the compression direction) when applying a load from 98 N as an initial load to 1275 N as a final load to the core is preferably 2.5 mm or more, more preferably 3.0 mm or more, and is preferably 4.5 mm or less, more preferably 4.0 mm or less. If the compression deformation amount is 2.5 mm or more, the shot feeling is better, and if the compression deformation amount is 4.5 mm or less, the resilience is better.

The golf ball body preferably has a core and a cover. Herein, the cover means a layer disposed on the outermost side of the golf ball body (also referred to as "outermost cover").

The cover composition constituting the cover preferably contains a resin component. Examples of the resin component include various resins such as an ionomer resin, a polyester resin and a polyamide resin, a thermoplastic polyurethane elastomer having a trade name of "Elastollan (registered trademark)" available from BASF Japan Ltd., a thermoplastic polyamide elastomer having a trade name of "Pebax (registered trademark)" available from Arkema K. K., a thermoplastic polyester elastomer having a trade name of "Hytrel (registered trademark)" available from Du Pont-Toray Co., Ltd., and a thermoplastic styrene elastomer having a trade name of "Rabalon (registered trademark)" available from Mitsubishi Chemical Corporation.

Examples of the ionomer resin include a product obtained by neutralizing at least a part of carboxyl groups of a binary copolymer composed of an olefin and an α,β-unsaturated carboxylic acid having 3 to 8 carbon atoms with a metal ion; a product obtained by neutralizing at least a part of carboxyl groups of a ternary copolymer composed of an olefin, an α,β-unsaturated carboxylic acid having 3 to 8 carbon atoms and an α,β-unsaturated carboxylic acid ester with a metal ion; and a mixture thereof. The olefin is preferably an olefin having 2 to 8 carbon atoms. Examples of the olefin include ethylene, propylene, butene, pentene, hexene, heptene and octene, and ethylene is particularly preferred. Examples of the α,β-unsaturated carboxylic acid having 3 to 8 carbon atoms include acrylic acid, methacrylic acid, fumaric acid, maleic acid and crotonic acid, and acrylic acid or methacrylic acid is particularly preferred. In addition, examples of the α,β-unsaturated carboxylic acid ester include methyl ester, ethyl ester, propyl ester, n-butyl ester, isobutyl ester of acrylic acid, methacrylic acid, fumaric acid and maleic acid, and acrylic acid ester or methacrylic acid ester is particularly preferred. Among them, as the ionomer resin, a metal ion-neutralized product of ethylene-(meth)acrylic acid binary copolymer or a metal ion-neutralized product of ethylene-(meth)acrylic acid-(meth)acrylic acid ester ternary copolymer is preferred.

Specific examples of the ionomer resin include "Himilan (registered trademark) (e.g. Himilan 1555 (Na), Himilan 1557 (Zn), Himilan 1605 (Na), Himilan 1706 (Zn), Himilan 1707 (Na), Himilan AM3711 (Mg), Himilan AM7337 (Na), Himilan AM7329 (Zn); and a ternary copolymer ionomer resin such as Himilan 1856 (Na) and Himilan 1855 (Zn))" available from Mitsui-Du Pont Polychemicals Co., Ltd.

Examples of the ionomer resin available from E.I. du Pont de Nemours and Company include "Surlyn (registered trademark) (e.g. Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li); and a ternary copolymer ionomer resin such as Surlyn 8120 (Na), Surlyn 8320 (Na), Surlyn 9320 (Zn), Surlyn 6320 (Mg), HPF1000 (Mg), and HPF2000 (Mg))".

Examples of the ionomer resin available from ExxonMobil Chemical Corporation include "Iotek (registered trademark) (e.g. Iotek 8000 (Na), Iotek 8030 (Na), Iotek 7010 (Zn), Iotek 7030 (Zn); and a ternary copolymer ionomer resin such as Iotek 7510 (Zn), and Iotek 7520 (Zn))".

It should be noted that Na, Zn, Li, Mg and the like described in the parentheses after the trade names of the ionomer resins indicate metal types of neutralizing metal ions of the ionomer resins. The ionomer resin may be used solely or as a mixture of at least two of them.

The cover composition preferably contains a thermoplastic polyurethane elastomer or an ionomer resin as the resin component. The amount of the polyurethane or ionomer resin in the resin component of the cover composition is preferably 40 mass % or more, more preferably 50 mass % or more, even more preferably 60 mass % or more, and most preferably 70 mass % or more. In addition, it is also preferred that the resin component of the cover composition consists of the thermoplastic polyurethane elastomer or the ionomer resin. It is noted that when the ionomer resin is used, a thermoplastic styrene elastomer is preferably used in combination. In this case, the mass ratio of the ionomer resin to the thermoplastic styrene elastomer (ionomer resin/thermoplastic styrene elastomer) is preferably 40/60 or more, more preferably 45/55 or more, and even more preferably 50/50 or more, and is preferably 80/20 or less, more preferably 70/30 or less, and even more preferably 60/40 or less. If the mass ratio of the ionomer resin to the thermoplastic styrene elastomer in the resin component of the cover composition falls within the above range, a synergistic effect with the spin performance improvement effect on approach shots based on the paint film according to the present invention is achieved, and thus the obtained golf ball has further improved spin performance on approach shots.

In addition to the above-described resin component, the cover composition may further contain a pigment component such as a white pigment (e.g. titanium oxide), a blue pigment (e.g. ultramarine blue) and a red pigment, a weight adjusting agent such as zinc oxide, calcium carbonate and barium sulfate, a dispersant, an antioxidant, an ultraviolet absorber, a light stabilizer, a fluorescent material or fluorescent brightener, unless they impair the performance of the cover.

Examples of the method for molding the cover composition into the cover include a method which comprises injection molding the cover composition directly onto the spherical body; and a method which comprises molding the cover composition into a hollow shell, covering the spherical body with a plurality of the hollow shells and performing compression molding (preferably a method which comprises molding the cover composition into a hollow half-shell, covering the spherical body with two of the half-shells and performing compression molding).

The concave portions called "dimple" are usually formed on the surface of the cover when molding the cover. The total number of the dimples formed on the cover is preferably 200 or more and 500 or less. If the total number of the dimples is less than 200, the dimple effect is hardly obtained. In addition, if the total number of the dimples exceeds 500, the dimple effect is hardly obtained because the size of the respective dimple is small. The shape (shape in a plan view) of the dimples formed on the cover includes, without any limitation, a circle; a polygonal shape such as a roughly triangular shape, a roughly quadrangular shape, a roughly pentagonal shape and a roughly hexagonal shape; and other irregular shape. These shapes may be employed solely, or at least two of them may be employed in combination.

It is preferred that the hardness of the cover is appropriately set in accordance with the desired performance of the golf ball. For example, in case of a so-called distance golf ball focusing on the flight distance, the cover preferably has a hardness of 50 or more, more preferably 55 or more in shore D hardness, and preferably has a hardness of 80 or less, more preferably 70 or less in shore D hardness. If the cover has the hardness of 50 or more, the obtained golf ball travels a greater flight distance on driver shots. In addition, if the cover has the hardness of 80 or less, the obtained golf ball has more excellent durability. Further, in case of a so-called spin golf ball focusing on controllability, the cover preferably has a hardness of less than 50, more preferably 45 or less, and even more preferably 40 or less in Shore D hardness, and preferably has a hardness of 20 or more, more preferably 23 or more, and even more preferably 25 or more in Shore D hardness. If the cover has the hardness of less than 50, the spin rate on approach shots becomes higher and thus the obtained golf ball has more excellent controllability. In addition, if the cover has the hardness of 20 or more, the abrasion resistance is enhanced. It is noted that the hardness of the cover is a slab hardness of the cover composition molded into a sheet shape.

The thickness of the cover is preferably 0.3 mm or more, more preferably 0.4 mm or more, and even more preferably 0.5 mm or more, and is preferably 3.0 mm or less, more preferably 2.5 mm or less, and even more preferably 2.3 mm or less. If the thickness of the cover is 0.3 mm or more, the golf ball has better shot feeling as well as better durability. In addition, if the thickness of the cover is 3.0 mm or less, the resilience of the golf ball can be maintained.

The golf ball body according to the present invention may comprise at least one intermediate layer between the core and the cover. It is noted that the intermediate layer is sometimes referred to as an inner cover or outer core, depending on the construction of the golf ball.

The intermediate layer composition constituting the intermediate layer preferably contains a resin component. Examples of the resin component include a thermoplastic resin such as an ionomer resin, a polyurethane resin, a polyamide resin, and polyethylene; a thermoplastic elastomer such as a styrene elastomer, a polyolefin elastomer, a polyurethane elastomer, and a polyester elastomer; and a cured product of a rubber composition. Among them, the ionomer resin is preferred. Preferable examples of the ionomer resin include the ionomer resins listed in the resin components used in the cover composition. The intermediate layer may further contain a weight adjusting agent such as barium sulfate and tungsten, an antioxidant, and a pigment.

Examples of the method for molding the intermediate layer composition into the intermediate layer include a method which comprises injection molding the intermediate layer composition directly onto the core; and a method which comprises molding the intermediate layer composition into a hollow shell, covering the core with a plurality of the hollow shells and performing compression molding (preferably a method which comprises molding the intermediate layer composition into a hollow half-shell, covering the core with two of the half-shells and performing compression molding).

The hardness of the intermediate layer is preferably 50 or more, more preferably 55 or more, and is preferably 80 or less, more preferably 70 or less in Shore D hardness. If the hardness of the intermediate layer is 50 or more, the obtained golf ball travels a greater flight distance on driver shots, and shows a further increased spin rate on approach shots and hence more excellent controllability. In addition, if the hardness of the intermediate layer is 80 or less, the obtained golf ball has better shot feeling and durability. It is noted that the hardness of the intermediate layer is a slab hardness of the intermediate layer composition molded into a sheet shape.

It is preferred that there is a hardness difference between the intermediate layer and the cover. The hardness difference (intermediate layer-cover) between the intermediate layer and the cover is preferably 10 or more, more preferably 15 or more, even more preferably 20 or more, and most preferably 25 or more, and is preferably 60 or less, more preferably 50 or less, and even more preferably 40 or less in Shore D hardness. If the hardness difference between the intermediate layer and the cover falls within the above range, a synergistic effect with the spin performance improvement effect on approach shots based on the paint film according to the present invention is achieved, and thus the obtained golf ball has extremely improved spin performance on approach shots. In addition, the obtained golf ball exhibits especially improved shot feeling as well.

The Shore D hardness ratio (intermediate layer/cover) of the intermediate layer to the cover is preferably 1.1 or more, more preferably 1.2 or more, even more preferably 1.3 or more, and most preferably 1.5 or more, and is preferably 5 or less, more preferably 4 or less, and even more preferably 3 or less. If the Shore D hardness ratio of the intermediate layer to the cover falls within the above range, a synergistic effect with the spin performance improvement effect on approach shots based on the paint film according to the present invention is achieved, and thus the obtained golf ball has extremely improved spin performance on approach shots. In addition, the obtained golf ball exhibits especially improved shot feeling as well.

The thickness of the intermediate layer is preferably 0.3 mm or more, more preferably 0.4 mm or more, and even more preferably 0.5 mm or more, and is preferably 4.0 mm or less, more preferably 3.0 mm or less, even more preferably 2.5 mm or less, and most preferably 2.0 mm or less. If the thickness of the intermediate layer is 0.3 mm or more, the intermediate layer is easily molded and the obtained golf ball has better durability. In addition, if the thickness of the intermediate layer is 4.0 mm or less, the obtained golf ball has better resilience and shot feeling. It is noted that when the intermediate layer has a plurality of layers, it is preferred that the total thickness of the intermediate layers falls within the above range.

The golf ball body having the cover formed thereon is ejected from the mold, and is preferably subjected to surface treatments such as deburring, cleaning and sandblast where necessary. In addition, if desired, a mark may be formed.

The golf ball according to the present invention preferably has a diameter ranging from 40 mm to 45 mm. In light of satisfying the regulation of US Golf Association (USGA), the diameter is preferably 42.67 mm or more. In light of prevention of air resistance, the diameter is preferably 44 mm or less, more preferably 42.80 mm or less. The golf ball preferably has a mass of 40 g or more and 50 g or less. In light of obtaining greater inertia, the mass is preferably 44 g or more, more preferably 45.00 g or more. In light of satisfying the regulation of USGA, the mass is preferably 45.93 g or less.

When the golf ball has a diameter in a range from 40 mm to 45 mm, the compression deformation amount of the golf ball (shrinking amount of the golf ball along the compression direction) when applying a load from 98 N as an initial load to 1275 N as a final load to the golf ball is preferably 2.0 mm or more, more preferably 2.5 mm or more, and is preferably 4.0 mm or less, more preferably 3.5 mm or less. If the compression deformation amount is 2.0 mm or more, the golf ball does not become excessively hard and thus the shot feeling thereof is better. On the other hand, if the compression deformation amount is 4.0 mm or less, the resilience is greater.

EXAMPLES

Next, the present invention will be described in detail by way of examples. However, the present invention is not limited to the examples described below. Various changes and modifications without departing from the spirit of the present invention are included in the scope of the present invention.

[Measuring Method]

(1) Slab Hardness (Shore D Hardness)

Sheets with a thickness of about 2 mm were produced by injection molding the cover composition or the intermediate layer composition. The sheets were stored at 23° C. for two weeks. At least three of these sheets were stacked on one another so as not to be affected by the measuring substrate on which the sheets were placed, and the hardness of the stack was measured with an automatic hardness tester Digitest II available from Bareiss company, provided with a Shore D type spring hardness tester prescribed in ASTM-D2240.

(2) Core Hardness (Shore C Hardness)

The hardness of the core was measured with an automatic hardness tester Digitest II available from Bareiss company. The Shore C hardness measured at the surface of the core was adopted as the surface hardness of the core. In addition, the core was cut into two hemispheres to obtain a cut plane, and the Shore C hardness measured at the central point of the cut plane was adopted as the center hardness of the core.

(3) Compression Deformation Amount (mm)

The deformation amount of the core along the compression direction (shrinking amount of the core along the compression direction), when applying a load from an initial load of 98 N to a final load of 1275 N to the core, was measured.

(4) Loss Tangent Tan δ of Paint Film

The golf ball was cut into two hemispheres, and after the hemisphere was steadily arranged, an indenter was indented from a vertical direction into the surface of the paint film on the hemisphere, and the loss tangent tan δ of the paint film was measured at the frequencies of 1 Hz, 10 Hz, 105 Hz, respectively with the following measuring method. It is noted that the above measurement was conducted at five spots, and the average value thereof was adopted as the loss tangent tan δ of that paint film.

Measuring apparatus: "TI950 Tribo Indenter" available from Hysitron, Inc.

Indenter specification: Berkovich type

Test load (maximum indenting load): 100 μN

Frequency: 1 Hz, 10 Hz, 105 Hz

Measuring environment: 23° C., RH 50%, in the atmosphere (5) Elastic Modulus (GPa) and Hardness (GPa) of Paint Film The golf ball was cut into two hemispheres, and after the hemisphere was steadily arranged, an indenter was indented from a vertical direction into the surface of the paint film on the hemisphere, and the elastic modulus and the hardness of the paint film were calculated respectively based on the load-displacement curve measured with the following measuring method. It is noted that the above measurements were conducted at five spots respectively, and the average value thereof was adopted as the elastic modulus and the hardness of that paint film respectively.

Measuring apparatus: "TI950 Tribo Indenter" available from Hysitron, Inc.

Indenter specification: Berkovich type

Maximum indenting depth: 300 nm

Measuring environment: 23° C., RH 50%, in the atmosphere (6) Thickness of Paint Film (μm)

The golf ball was cut into two hemispheres, and the cross section of the paint film on the hemisphere was observed with a microscope (VHX-1000 available from Keyence Corporation) to obtain the thickness of the paint film.

(7) 10% Elastic Modulus of Paint Film (kgf/cm$^2$)

The 10% elastic modulus of the paint film was measured according to JIS K7161 (2014). Specifically, the base material and the curing agent were blended to prepare a paint, and the obtained paint was dried and cured at 40° C. for 4 hours to prepare a paint film (thickness: 0.05 mm). The paint film was punched out to prepare a test piece according to the test piece type 2 (width of parallel part: 10 mm, gauge length: 50 mm) prescribed in JIS K7127 (1999). The tensile test of the test piece was conducted with a precision universal tester (Autograph (registered trademark) available from Shimazu Corporation) under testing conditions of a length between grips: 100 mm, a tensile speed: 50 mm/min and a testing temperature: 23° C.

(8) Spin Rate on Approach Shots (rpm)

A sand wedge (CG 15 forged wedge (58°) available from Cleveland Golf) was installed on a swing machine available from True Temper Sports, Inc. The golf ball was hit at a head speed of 10 m/s, and the spin rate (rpm) thereof was measured by continuously taking a sequence of photographs of the hit golf ball. The measurement was conducted ten times for each golf ball, and the average value thereof was adopted as the spin rate.

(9) Shot Feeling

An actual hitting test was carried out by ten amateur golfers (high skilled persons) using a sand wedge (CG 15 forged wedge (58°) available from Cleveland Golf). In accordance with the number of people who answered the shot feeling was good (feeling like that the golf ball was lifted on the club face, feeling like that the golf ball gripped on the club surface, feeling like that the spin was imparted, feeling like that the golf ball was stuck on the club face, etc.), the golf balls were evaluated as follows.

E (Excellent): 8 or more

G (Good): 5 to 7

F (Fair): 3 to 4

P (Poor): 2 or less

(10) Stain Resistance

The golf ball was immersed for 30 seconds in an aqueous solution of tincture of iodine obtained by diluting a tincture of iodine (an ethanol solution containing 6 mass % of iodine and 4 mass % of potassium iodide) to 40 times, and then taken out. After the extra aqueous solution of tincture of iodine adhered on the surface of the golf ball was wiped off, color tones (L, a, b) of the golf ball before and after the immersion were measured with a color difference meter (CM3500D available from Konica Minolta Inc.), and the color difference (ΔE) was calculated according to the following equation. It is noted that a larger color difference (ΔE) value means a larger color change extent.

$$\Delta E=[(\Delta L)^2+(\Delta a)^2+(\Delta b)^2]^{1/2}$$

Evaluation Standard

E (Excellent): ΔE is 15 or less

G (Good): ΔE is more than 15 and 20 or less

P (Poor): ΔE is more than 20

1. Production of Core

The core rubber compositions having the formulations shown in Table 1 were kneaded and heat pressed in upper and lower molds, each having a hemispherical cavity, under the conditions show in Table 1 to produce spherical cores.

TABLE 1

| | | Core rubber composition No. | |
|---|---|---|---|
| | | I | II |
| Formulation (parts by mass) | Polybutadiene rubber | 100 | 100 |
| | Zinc acrylate | 23.5 | 30.5 |
| | Zinc oxide | 5 | 10 |
| | Barium sulfate | Appropriate amount | Appropriate amount |
| | 2-Thionaphthol | — | 0.1 |
| | Bis(pentabromophenyl) disulfide | — | 0.3 |
| | Dicumyl peroxide | 0.95 | 0.7 |
| | Benzoic acid | — | 2 |
| Molding conditions | Temperature (° C.) | 155 | 150 |
| | Time (min) | 18 | 19 |
| Compression deformation amount (mm) | | 3.5 | 3.3 |
| Center hardness (Shore C) | | 64 | 53 |
| Surface hardness (Shore C) | | 80 | 80 |
| Hardness difference (surface − center) (Shore C) | | 16 | 27 |

Polybutadiene rubber: "BR730 (high-cis polybutadiene)" available from JSR Corporation Zinc acrylate: "ZN-DA90S" available from Nihon Jyoryu Kogyo Co., Ltd.

Zinc oxide: "Ginrei R" available from Toho Zinc Co., Ltd.

Barium sulfate: "Barium Sulfate BD" available from Sakai Chemical Industry Co., Ltd.

2-Thionaphthol: available from Tokyo Chemical Industry Co., Ltd.

Bis(pentabromophenyl) disulfide: available from Sumitomo Seika Chemicals Co., Ltd.

Dicumyl peroxide: "Percumyl (registered trademark) D" available from NOF Corporation Benzoic acid: available from Sigma-Aldrich Co. LLC. (purity: at least 99.5 mass %)

2. Preparation of Intermediate Layer Composition and Cover Composition

According to the formulations shown in Tables 2 and 3, the materials were mixed with a twin-screw kneading extruder to prepare the intermediate layer compositions and the cover compositions in a pellet form. The extruding conditions were a screw diameter of 45 mm, a screw rotational speed of 200 rpm, and screw L/D=35, and the mixture was heated to 200° C. to 260° C. at the die position of the extruder.

TABLE 2

| | | Intermediate layer/ cover composition No. | | |
|---|---|---|---|---|
| | | a | b | c |
| Formulation (parts by mass) | Surlyn 8150 | — | — | 32.5 |
| | Surlyn 9150 | — | — | 32.5 |
| | Polyamide 6 | — | — | 35 |
| | Himilan AM7337 | 26 | — | — |
| | Himilan AM7329 | 26 | 55 | — |
| | Himilan 1555 | — | 45 | — |
| | Rabalon T3221C | 48 | — | — |
| | Barium sulfate | Appropriate amount | Appropriate amount | Appropriate amount |
| | Titanium oxide | 6 | 3 | 4 |
| Material hardness (Shore D) | | 35 | 62 | 72 |

Surlyn 8150: sodium ion-neutralized ethylene-methacrylic acid copolymer ionomer resin available from E. I. du Pont de Nemours and Company
Surlyn 9150: zinc ion-neutralized ethylene-methacrylic acid copolymer ionomer resin available from E. I. du Pont de Nemours and Company
Polyamide 6: available from Toray Industries, Inc.
Himilan AM7337: sodium ion-neutralized ethylene-methacrylic acid copolymer ionomer resin available from Du Pont-Mitsui Polychemicals Co., Ltd.
Himilan AM7329: zinc ion-neutralized ethylene-methacrylic acid copolymer ionomer resin available from Du Pont-Mitsui Polychemicals Co., Ltd.
Himilan 1555: sodium ion-neutralized ethylene-acrylic acid copolymer ionomer resin available from Du Pont-Mitsui Polychemicals Co., Ltd.
Rabalon T3221C: thermoplastic polystyrene elastomer available from Mitsubishi Chemical Co.
Barium sulfate: "Barium Sulfate BD" available from Sakai Chemical Industry Co., Ltd.
Titanium oxide: A220 available from Ishihara Sangyo Kaisha, Ltd.

TABLE 3

| | | Cover composition No. | |
|---|---|---|---|
| | | A | B |
| Formulation (parts by mass) | Elastollan NY80A | 100 | — |
| | Elastollan NY97A | — | 100 |
| | Titanium oxide | 4 | 4 |
| | Ultramarine blue | 0.04 | 0.04 |
| Material hardness (Shore D) | | 27 | 47 |

Elastollan NY 80A: thermoplastic polyurethane elastomer available from BASF Japan Corporation
Elastollan NY 97A: thermoplastic polyurethane elastomer available from BASF Japan Corporation
Titanium oxide: A220 available from Ishihara Sangyo Kaisha, Ltd.

3. Production of Golf Ball Body

Golf Ball Bodies No. 1 to 8

The cover composition in the pellet form obtained above was directly injection molded onto the spherical core obtained above to produce the cover. The upper and lower molds for molding have a semispherical cavity and a retractable hold pin for holding the spherical core. When forming the cover, the hold pin was protruded to hold the core, and the cover composition heated to 260° C. was injected within 0.3 second into the mold held under a pressure of 80 tons, and cooled for 30 seconds. Then, the golf ball was ejected from the mold.

Golf Ball Bodies No. 9 to 10

The intermediate layer composition obtained above was directly injection molded onto the core obtained above to produce the spherical body having the core covered with an intermediate layer. The upper and lower molds for molding have a semispherical cavity and a retractable hold pin for holding the spherical body. When forming the intermediate layer, the hold pin was protruded to hold the core, and the intermediate layer composition heated to 260° C. was injected within 0.3 second into the mold held under a pressure of 80 tons, and cooled for 30 seconds. Then, the spherical body was ejected from the mold. The cover composition in the pellet form obtained above was charged into each of the depressed part of the lower mold of the mold for molding half shells, and a pressure was applied to mold the half shells. The compression molding of the half shells was conducted under the conditions of a molding temperature of 170° C., a molding time of 5 minutes and a molding pressure of 2.94 MPa. The spherical body obtained above was concentrically covered with two of the half shells, and compression molding was conducted to form the cover. The compression molding of the cover was conducted under the conditions of a molding temperature of 145° C., a molding time of 2 minutes and a molding pressure of 9.8 MPa.

4. Preparation of Polyol Composition

As the polyol component, polyoxytetramethylene glycol (PTMG, number average molecular weight: 650) and trimethylolpropane (TMP) were dissolved in a solvent (toluene and methyl ethyl ketone). It is noted that the molar ratio (PTMG:TMP) was 1.8:1.0. Dibutyltin dilaurate which was used as a catalyst was added therein in an amount of 0.1 mass % with respect to the total amount of the base material. While keeping the temperature of the obtained polyol solution at 80° C., isophorone diisocyanate (IPDI), as the polyisocyanate component, was added dropwise to the polyol solution and mixed. It is noted that the molar ratio (NCO/OH) of the NCO group in the polyisocyanate component to the OH group in the polyol component was 0.6. After finishing the addition of isophorone diisocyanate, stirring was continued until the isocyanate group no longer existed. Then, the reaction liquid was cooled to a room temperature to prepare the urethane polyol (solid content: 30 mass %). The amount of PTMG in the obtained polyol composition was 67 mass %, the hydroxyl value of the solid component was 67.4 mgKOH/g, and the weight average molecular weight of the urethane polyol was 4867.

5. Preparation of Polyisocyanate Composition 30 parts by mass of the isocyanurate-modified product of hexamethylene diisocyanate (Duranate (registered trademark) TKA-100 (NCO amount: 21.7 mass %) available from Asahi Kasei Chemicals Corporation), 30 parts by mass of the biuret-modified product of hexamethylene diisocyanate (Duranate 21S-75E (NCO amount: 15.5 mass %) available from Asahi Kasei Chemicals Corporation), and 40 parts by mass of the isocyanurate-modified product of isophorone diisocyanate (Desmodur (registered trademark) Z 4470 (NCO amount: 11.9 mass %) available from Sumika Bayer Urethane Co., Ltd.) were mixed. As the solvent, a mixed solvent of methyl ethyl ketone, n-butyl acetate and toluene was added therein to adjust the concentration of the polyisocyanate component to 60 mass %.

6. Preparation of Paint Film

The surface of the golf ball body obtained above was treated with sandblast and marked. The paint having the formulations shown in Table 4 were applied with an spray gun, and dried for 24 hours in an oven at 40° C. to obtain the golf balls having a mass of 45.3 g. The application of the paint was conducted as follows. The golf ball body was placed in a rotating member provided with three prongs, and the rotating member was allowed to rotate at 300 rpm. The application of the paint was conducted by spacing a spray distance (7 cm) between the air gun and the golf ball body, and moving the air gun in an up and down direction. The application of the paint was conducted under the spraying conditions of spraying air pressure: 0.15 MPa, compressed air tank pressure: 0.10 MPa, painting time per one application: one second, atmosphere temperature: 20° C. to 27° C., and atmosphere humidity: 65% or less. Evaluation results regarding the obtained golf balls are shown in Table 4.

TABLE 4

| | | Golf ball No. | | | | |
|---|---|---|---|---|---|---|
| | | 1 | 2 | 3 | 4 | 5 |
| Core | Core No. | I | I | I | I | I |
| | Diameter (mm) | 38.7 | 38.7 | 38.7 | 38.7 | 38.7 |
| | Center hardness (Shore C) | 64 | 64 | 64 | 64 | 64 |
| | Surface hardness (Shore C) | 80 | 80 | 80 | 80 | 80 |
| | Hardness difference (Shore C) | 16 | 16 | 16 | 16 | 16 |
| Intermediate layer | Intermediate layer composition No. | — | — | — | — | — |
| | Material hardness (Shore D) | — | — | — | — | — |
| | Thickness (mm) | — | — | — | — | — |
| Cover | Cover composition No. | b | b | b | b | b |
| | Material hardness (Shore D) | 62 | 62 | 62 | 62 | 62 |
| | Thickness (mm) | 2.0 | 2.0 | 2.0 | 2.0 | 2.0 |
| Paint film | Paint Mass ratio (base material/curing agent) | 2.6 | 3.1 | 6.4 | 6.8 | 8.3 |
| | Molar ratio (NCO/OH) | 1.60 | 1.20 | 0.65 | 0.61 | 0.50 |
| | Elastic modulus (GPa) | 0.660 | 0.570 | 0.510 | 0.160 | 0.084 |
| | Hardness (GPa) | 0.030 | 0.026 | 0.019 | 0.004 | 0.001 |
| | tanδ/1 Hz | 0.135 | 0.171 | 0.201 | 0.432 | 0.493 |
| | tanδ/10 Hz | 0.130 | 0.148 | 0.167 | 0.327 | 0.353 |
| | tanδ/105 Hz | 0.115 | 0.130 | 0.138 | 0.254 | 0.265 |
| | Absolute value of slope of linear approximation curve | 0.0002 | 0.0003 | 0.0005 | 0.0013 | 0.0017 |
| | 10% elastic modulus (kgf/cm$^2$) | 286 | 190 | 75 | 65 | 40 |
| | Thickness (μm) | 10 | 10 | 10 | 10 | 10 |
| Ball evaluation | Spin rate on approach shots (rpm) | 3650 | 3800 | 3950 | 4000 | 4100 |
| | Shot feeling | P | F | E | E | E |
| | Stain resistance | E | E | G | G | G |

| | | Golf ball No. | | | | |
|---|---|---|---|---|---|---|
| | | 6 | 7 | 8 | 9 | 10 |
| Core | Core No. | I | I | I | II | II |
| | Diameter (mm) | 38.7 | 38.7 | 38.7 | 39.7 | 39.7 |
| | Center hardness (Shore C) | 64 | 64 | 64 | 53 | 53 |
| | Surface hardness (Shore C) | 80 | 80 | 80 | 80 | 80 |
| | Hardness difference (Shore C) | 16 | 16 | 16 | 27 | 27 |
| Intermediate layer | Intermediate layer composition No. | — | — | — | b | b |
| | Material hardness (Shore D) | — | — | — | 62 | 62 |
| | Thickness (mm) | — | — | — | 1.0 | 1.0 |
| Cover | Cover composition No. | b | a | c | A | B |
| | Material hardness (Shore D) | 62 | 35 | 72 | 27 | 47 |
| | Thickness (mm) | 2.0 | 2.0 | 2.0 | 0.5 | 0.5 |
| Paint film | Paint Mass ratio (base material/curing agent) | 20.0 | 6.8 | 6.8 | 6.8 | 6.8 |
| | Molar ratio (NCO/OH) | 0.20 | 0.61 | 0.61 | 0.61 | 0.61 |
| | Elastic modulus (GPa) | 0.041 | 0.160 | 0.160 | 0.160 | 0.160 |
| | Hardness (GPa) | 0.001 | 0.004 | 0.004 | 0.004 | 0.004 |
| | tanδ/1 Hz | 0.596 | 0.432 | 0.432 | 0.432 | 0.432 |
| | tanδ/10 Hz | 0.395 | 0.327 | 0.327 | 0.327 | 0.327 |
| | tanδ/105 Hz | 0.285 | 0.254 | 0.254 | 0.254 | 0.254 |
| | Absolute value of slope of linear approximation curve | 0.0022 | 0.0013 | 0.0013 | 0.0013 | 0.0013 |
| | 10% elastic modulus (kgf/cm$^2$) | 3 | 65 | 65 | 65 | 65 |
| | Thickness (μm) | 10 | 10 | 10 | 10 | 10 |
| Ball evaluation | Spin rate on approach shots (rpm) | 4200 | 4150 | 3650 | 4650 | 4250 |
| | Shot feeling | E | E | G | E | G |
| | Stain resistance | P | G | G | G | G |

It is apparent from the results shown in Table 4 that the golf ball comprising a paint film which is such that a linear approximation curve obtained by a least square method has a slope in an absolute value ranging from 0.0001 to 0.0020 when a loss tangent tan δ of the paint film in the state of being formed on the surface of the golf ball body measured by the measuring condition 1 is plotted as a vertical axis against a measuring frequency (Hz) as a horizontal axis, and that an elastic modulus of the paint film in the state of being formed on the surface of the golf ball body measured by the measuring condition 2 ranges from 0.040 GPa to 0.600 GPa, has good spin performance on approach shots and good shot feeling as well as excellent stain resistance. In particular, in the cases that the cover has a material hardness of less than 50 in Shore D hardness (the golf balls No. 7, 9, 10), and in the cases that an intermediate layer is disposed between the core and the cover, and the hardness difference (intermediate layer—cover) between the intermediate layer and the cover ranges from 10 to 60 in Shore D hardness (the golf balls No. 9, 10), the spin performance on approach shots is extremely enhanced.

This application is based on Japanese patent application No. 2016-253564 filed on Dec. 27, 2016, the content of which is hereby incorporated by reference.

The invention claimed is:

1. A golf ball comprising a golf ball body and a paint film formed on a surface of the golf ball body, wherein a base resin constituting the paint film is a polyurethane obtained through a reaction between a polyol compound and a polyisocyanate compound, the polyol compound contains a urethane polyol, the urethane polyol contains a polyether diol having a number average molecular weight of 550 or more and 3000 or less as a polyol component, and the paint film is such that a linear approximation curve obtained by a least square method has a slope in an absolute value ranging from 0.0004 to 0.0015 when a loss tangent tan δ of the paint film in a state of being formed on the surface of the golf ball body measured by the following measuring condition 1 is plotted as a vertical axis against a measuring frequency (Hz) as a horizontal axis, and that an elastic modulus of the paint film in the state of being formed on the surface of the golf ball body measured by the following measuring condition 2 ranges from 0.040 GPa to 0.600 GPa:

<Measuring condition 1>

Measuring apparatus: "TI950 Tribo Indenter" available from Hysitron, Inc.

Indenter specification: Berkovich type

Test load (maximum indenting load): 100 μN

Frequency: 1 Hz, 10 Hz, 105 Hz

Measuring environment: 23° C., RH 50%, in the atmosphere;

<Measuring condition 2>

Measuring apparatus: "TI950 Tribo Indenter" available from Hysitron, Inc.

Indenter specification: Berkovich type

Maximum indenting depth: 300 nm

Measuring environment: 23° C., RH 50%, in the atmosphere.

2. The golf ball according to claim 1, wherein the linear approximation curve has the slope in an absolute value ranging from 0.0005 to 0.0013.

3. The golf ball according to claim 1, wherein the loss tangent tan δ of the paint film in the state of being formed on the surface of the golf ball body at the measuring frequency of 1 Hz ranges from 0.200 to 0.700.

4. The golf ball according to claim 1, wherein the loss tangent tan δ of the paint film in the state of being formed on the surface of the golf ball body at the measuring frequency of 10 Hz ranges from 0.150 to 0.400.

5. The golf ball according to claim 1, wherein the loss tangent tan δ of the paint film in the state of being formed on the surface of the golf ball body at the measuring frequency of 105 Hz ranges from 0.140 to 0.300.

6. The golf ball according to claim 1, wherein a hardness of the paint film in the state of being formed on the surface of the golf ball body measured by the above measuring condition 2 ranges from 0.001 GPa to 0.020 GPa.

7. The golf ball according to claim 1, wherein the paint film has a thickness in a range from 5 μm to 50 μm.

8. The golf ball according to claim 1, wherein the polyisocyanate compound contains an isocyanurate-modified product of hexamethylene diisocyanate, a biuret-modified product of hexamethylene diisocyanate and an isocyanurate-modified product of isophorone diisocyanate.

9. The golf ball according to claim 1, wherein in a reaction between the polyol compound and the polyisocyanate compound, a molar ratio (NCO/OH) of an isocyanate group (NCO group) in the polyisocyanate compound to a hydroxyl group (OH group) in the polyol compound ranges from 0.15 to 1.20.

10. The golf ball according to claim 1, wherein the golf ball body comprises a core and a cover covering the core.

11. The golf ball according to claim 10, wherein the golf ball body further comprises at least one intermediate layer between the core and the cover.

12. The golf ball according to claim 11, wherein a hardness difference (intermediate layer-cover) between the intermediate layer and the cover ranges from 10 to 60 in Shore D hardness.

13. The golf ball according to claim 11, wherein a Shore D hardness ratio (intermediate layer/cover) of the intermediate layer to the cover ranges from 1.1 to 5.

14. The golf ball according to claim 11, wherein the intermediate layer has a material hardness ranging from 50 to 80 in Shore D hardness.

15. The golf ball according to claim 10, wherein a hardness difference (Hs−Ho) between a surface hardness Hs of the core and a center hardness Ho of the core ranges from 10 to 50 in Shore C hardness.

16. The golf ball according to claim 15, wherein the surface hardness Hs of the core ranges from 60 to 100 in Shore C hardness.

17. The golf ball according to claim 15, wherein the center hardness Ho of the core ranges from 40 to 80 in Shore C hardness.

18. The golf ball according to claim 1, wherein the golf ball body is a two-piece construction.

* * * * *